US011827481B2

(12) United States Patent
Linders

(10) Patent No.: US 11,827,481 B2
(45) Date of Patent: Nov. 28, 2023

(54) LIFTABLE TRANSPORT PINCH FOR A SHEET PRINTER

(71) Applicant: Canon Production Printing Holding B.V., Venlo (NL)

(72) Inventor: Luc Linders, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 107 days.

(21) Appl. No.: 17/578,860

(22) Filed: Jan. 19, 2022

(65) Prior Publication Data

US 2022/0242685 A1 Aug. 4, 2022

(30) Foreign Application Priority Data

Feb. 1, 2021 (EP) ..... 21154547

(51) Int. Cl.
*B65H 5/06* (2006.01)
*B41J 11/04* (2006.01)

(52) U.S. Cl.
CPC ..... *B65H 5/062* (2013.01); *B41J 11/04* (2013.01); *B65H 2402/31* (2013.01); *B65H 2402/54* (2013.01); *B65H 2402/80* (2013.01); *B65H 2403/60* (2013.01); *B65H 2601/52* (2013.01)

(58) Field of Classification Search
CPC ..... B65H 5/062; B65H 2402/31; B65H 2402/54; B65H 2402/80; B65H 2402/60; B65H 2402/33; B41J 11/04
See application file for complete search history.

(56) References Cited

U.S. PATENT DOCUMENTS 5,303,913 A * 4/1994 Trouquilla ..... B65H 5/062 271/274
5,499,810 A 3/1996 Tranquilla
7,431,292 B2 * 10/2008 Goto ..... B65H 5/062 271/274
2012/0001383 A1 1/2012 Herrmann et al.
2014/0124334 A1 * 5/2014 Sado ..... B65G 13/02 198/604

FOREIGN PATENT DOCUMENTS

JP 2002-154700 A 5/2002

OTHER PUBLICATIONS

European Search Report, issued in Application No. 21 15 4547, dated Jun. 23, 2021.

* cited by examiner

*Primary Examiner* — Jennifer Bahls
(74) *Attorney, Agent, or Firm* — Birch, Stewart, Kolasch & Birch, LLP

(57) ABSTRACT

A liftable transport pinch is provided with a simplified construction to enhance lifetime and productivity. This transport device includes at least one roller mounted on an arm, and an actuator connected to a frame for moving the roller between a first and second position. The arm is mounted onto the frame by means of an elastic hinge element. The elastic hinge element provides a simple, cheap, wear-resistant, and easy-to-assembly alternative to prior art solutions.

17 Claims, 3 Drawing Sheets

LIFTABLE TRANSPORT PINCH FOR A SHEET PRINTER

FIELD OF THE INVENTION

The present invention generally pertains to a transport device for a sheet printer, a sheet printer comprising such a transport device, and a method for forming such a transport device.

BACKGROUND ART

Liftable pinches are applicable in sheet printers, specifically mid to large volume printers. A transport pinch is generally formed of two opposing rollers, one which is driven by means of a motor, such that a sheet pinched between the rollers is moved further along the transport path at which the transport pinch is positioned. In specific cases, it is desired to allow the transport pinch to release the sheet before it has exited the transport pinch by distancing the rollers from one another. For example, the sheet may be transferred from the transport pinch to a registration device which rotates and/or laterally translates the sheet. A liftable transport pinch is generally formed by mounting an arm holding one of the rollers on a pivot rod. An actuator is provided to alternate the rollers between adjacent and remote positions with respect to one another. At high print speeds (e.g. 300 sheets per minute) the transport pinch is required to operate at a similar frequency. The fast switching may result in oscillations in the arm, which need to be sufficiently reduced before accurately switching to another position and/or reliably releasing or further transporting the sheet. While springs may be provided on the arm to dampen oscillations, the dampening force of such springs is relatively low. Additionally, the pivot rod and/or the bearings required for allowing the arm to pivot were found to be sensitive to wear under this alternating load. Further, the construction is relatively complex and cumbersome to assemble.

SUMMARY OF THE INVENTION

It is an object of the present invention to provide an improved liftable transport pinch, specifically one which improves productivity and/or provides a simpler construction.

The present invention relates to a transport device for a sheet printer comprising:

- at least one roller mounted on an arm;
- an actuator connected to a frame for moving the roller between a first and second position,
- wherein the arm is mounted onto the frame by means of an elastic hinge element.

The elastic hinge element provides a simple support for the arm holding the roller, while defining the pivot axis around which the arm is allowed to pivot due to the elastic deformation of the hinge element. The elastic hinge element further acts as a damper, which reduces oscillations, shortening the delay between switching, while also reducing play and thereby decreasing (spring) hysteresis, and thus improving productivity. The dampening forces which can be achieved with the elastic hinge element are relatively large as compared to its overall dimensions. This allows for a compact construction. The pivot axis and damper are thus provided by the elastic hinge element, which does not require bearings for e.g. rotating parts. This results in a compact and simple construction, which is easy to assemble due to the low number of components. Thus, the object of the present invention has been achieved.

In an embodiment, the elastic hinge element defines a pivot axis for the arm, around which pivot axis the arm pivots upon actuation by the actuator. The elastic hinge element comprises a hinge axis or line, around which the arm substantially pivots. It will be appreciated that said hinge line may deform to a certain degree as the hinge element is deformed, dependent on the dimensions and materials applied in the hinge element.

In an embodiment, the elastic hinge element comprises a leaf spring. The elastic hinge element is formed of a leaf spring, preferably formed of an elastic plate. Preferably the leaf spring is formed of a metal plate or sheet. The leaf spring is in another embodiment configured as a damper to reduce oscillation of the arm after actuating the arm between the first and second position. The leaf spring allows for a relatively high elastic dampening force compared to the displacement of the arm. Thus a high braking force is generated to swiftly reduce or remove oscillations after actuating the arm.

In an embodiment, the leaf spring is a folded leaf spring. The elastic hinge element comprises or is formed of a folded leaf spring. The leaf spring, for example formed of a sheet or plate of elastic material, is folded around at least one fold line or axis. The fold line preferably corresponds to or substantially defines the pivot axis of the arm. This allows the arm to be pivotable without bearings. The folded leaf spring is a simple and cost effective method of forming an elastic hinge element.

In an embodiment, the hinge element is defined by channel in the plate. The channel is an elongated through-hole extending between the front and back side surface of the plate. The channel is provided at a predetermined location to achieve an elastic hinge element with the desired elasticity and range of motion required for the operation of the transport device. This allows the plate to extend to the lateral sides of a transport path section to be connected there to the frame. A standard plate materials may thus be used. It will be appreciated that the channel may range from a narrow elongated channel to a large opening in the plate, dependent on the manufacturing method applied.

In an embodiment, the channel extends between two points adjacent a fold line around which the plate is folded. The channel in combination with the fold line substantially circumscribe a through-hole in the plate. The through-hole may be partially filled with a plate portion connected to the fold line, though the through-hole may also be vacant if the corresponding material has been cut out or punched out. The channel provides a local reduction in the rigidity of the plate allowing the hinge element to be configured to the specifications of the user. The arm is preferably positioned in between the two points adjacent the fold line, when viewing perpendicular to the plate.

In an embodiment, the arm is rigid. The arm is rigid as compared to the section of the elastic hinge element on which the arm has been mounted. When exerting a force on the arm, the hinge element will deform while the arm substantially maintains its shape.

In an embodiment, the arm comprises at least one beam element with a U-shaped cross-section. The rigidity of the arm may be increased by forming the arm of one or more U-shaped beam elements. The legs of the U-shape provide a convenient mounting point for the roller, while the central part of the U-shape may be mounted on the hinge element or a central portion of the arm connected to the hinge element. Opposing U-shaped beam elements may be provided for a compact yet rigid construction of the arm.

In an embodiment, the first and/or second position is defined by a stop element for limiting the movement of the arm, and wherein the elastic hinge element dampens oscillations of the arm after the stop element has been contacted. In case of high productivity, the arm encounters the stop element with a relatively large velocity or force, which causes the arm to bounce back and/or oscillate. The arm may thereby briefly return at least partially to the its starting position before actuation. This results in a delay, as for accurate operation the position of the liftable hinge element needs to be determined to avoid damage the image receiving member. Since the arm is relatively rigid, the force and/or oscillation is transferred to the hinge element, which acts as a relatively strong damper and thus minimizes the delay.

The present invention further relates to a sheet printer comprising a transport device according to the present invention.

The present invention further relates to a method for forming a transport device for a sheet printer, comprising the steps of:

Forming an elastic hinge element by folding a plate;

Mounting a roller and an actuator on the elastic hinge element.

The elastic hinge element as described above may be formed of a plate, for example a metal sheet. The plate is folded to comprise at least one fold line to form the elastic hinge element. Preferably, a through-hole is provided in the plate near the position where the arm is to be mounted. The through-hole is for example a channel extending between two points adjacent or at the fold line. The roller is mounted on the elastic hinge element for example by means of arm. The arm may be formed separately, e.g. from U-shaped beam elements, or integrally with the hinge element. The transport device may then be positioned along a transport path section opposite to a drive roller to create a fast, reliable, and low-costs liftable transport pinch.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1:
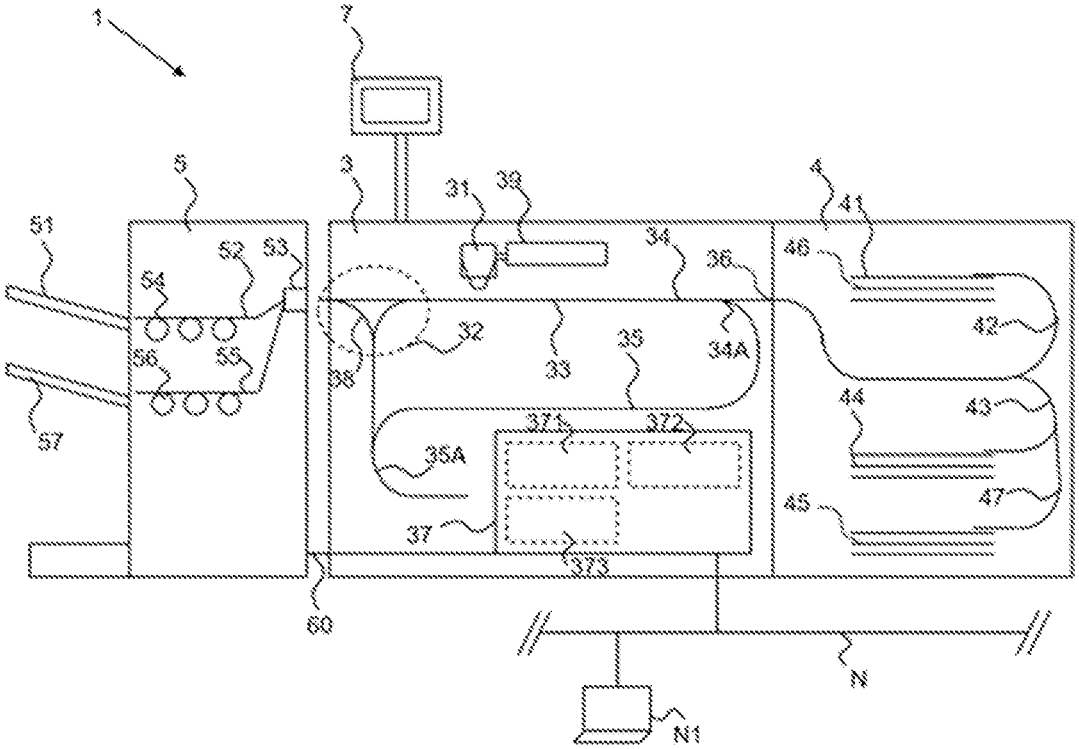
FIG. 1 is a schematic side view of a sheet printer.

The present invention will now be described with reference to the accompanying drawings, wherein the same reference numerals have been used to identify the same or similar elements throughout the several views.

FIG. 1 shows schematically an embodiment of a printing system 1 according to the present invention. The printing system 1, for purposes of explanation, is divided into an output section 5, a print engine and control section 3, a local user interface 7 and an input section 4. While a specific printing system is shown and described, the disclosed embodiments may be used with other types of printing system such as an ink jet print system, an electrographic print system, etc.

The output section 5 comprises a first output holder 52 for holding printed image receiving material, for example a plurality of sheets. The output section 5 may comprise a second output holder 55. While 2 output holders are illustrated in FIG. 1, the number of output holders may include one, two, three or more output holders. The printed image receiving material is transported from the print engine and control section 3 via an inlet 53 to the output section 5. When a stack ejection command is invoked by the controller 37 for the first output holder 52, first guiding means 54 are activated in order to eject the plurality of sheets in the first output holder 52 outwards to a first external output holder 51. When a stack ejection command is invoked by the controller 37 for the second output holder 55, second guiding means 56 are activated in order to eject the plurality of sheets in the second output holder 55 outwards to a second external output holder 57.

The output section 5 is digitally connected by means of a cable 60 to the print engine and control section 3 for bi-directional data signal transfer.

The print engine and control section 3 comprises a print engine and a controller 37 for controlling the printing process and scheduling the plurality of sheets in a printing order before they are separated from input holder 44, 45, 46.

The controller 37 is a computer, a server or a workstation, connected to the print engine and connected to the digital environment of the printing system, for example a network N for transmitting a submitted print job to the printing system 1. In FIG. 1 the controller 37 is positioned inside the print engine and control section 3, but the controller 37 may also be at least partially positioned outside the print engine and control section 3 in connection with the network N in a workstation N1.

The controller 37 comprises a print job receiving section 371 permitting a user to submit a print job to the printing system 1, the print job comprising image data to be printed and a plurality of print job settings. The controller 37 comprises a print job queue section 372 comprising a print job queue for print jobs submitted to the printing system 1 and scheduled to be printed. The controller 37 comprises a sheet scheduling section 373 for determining for each of the plurality of sheets of the print jobs in the print job queue an entrance time in the paper path of the print engine and control section 3, especially an entrance time for the first pass and an entrance time for the second pass in the loop in the paper path according to the present invention. The sheet scheduling section 373 will also be called scheduler 373 hereinafter.

The sheet scheduling section 373 takes the length of the loop into account. The length of the loop corresponds to a loop time duration of a sheet going through the loop dependent on the velocity of the sheets in the loop. The loop time duration may vary per kind of sheet, i.e. a sheet with different media properties.

Resources may be recording material located in the input section 4, marking material located in a reservoir 39 near or in the print head or print assembly 31 of the print engine, or finishing material located near the print head or print assembly 31 of the print engine or located in the output section 5 (not shown).

The paper path comprises a plurality of paper path sections 32, 33, 34, 35 for transporting the image receiving material from an entry point 36 of the print engine and control section 3 along the print head or print assembly 31 to the inlet 53 of the output section 5. The paper path sections 32, 33, 34, 35 form a loop according to the present invention. The loop enables the printing of a duplex print job and/or a mix-plex job, i.e. a print job comprising a mix of sheets intended to be printed partially in a simplex mode and partially in a duplex mode.

The print head or print assembly 31 is suitable for ejecting and/or fixing marking material to image receiving material. The print head or print assembly 31 is positioned near the paper path section 34. The print head or print assembly 31 may be an inkjet print head, a direct imaging toner assembly or an indirect imaging toner assembly.

While an image receiving material is transported along the paper path section 34 in a first pass in the loop, the image receiving material receives the marking material through the print head or print assembly 31. A next paper path section 32 is a flip unit 32 for selecting a different subsequent paper path for simplex or duplex printing of the image receiving material. The flip unit 32 may be also used to flip a sheet of image receiving material after printing in simplex mode before the sheet leaves the print engine and control section 3 via a curved section 38 of the flip unit 32 and via the inlet 53 to the output section 5. The curved section 38 of the flip unit 32 may not be present and the turning of a simplex page has to be done via another paper path section 35.

In case of duplex printing on a sheet or when the curved section 38 is not present, the sheet is transported along the loop via paper path section 35A in order to turn the sheet for enabling printing on the other side of the sheet. The sheet is transported along the paper path section 35 until it reaches a merging point 34A at which sheets entering the paper path section 34 from the entry point 36 interweave with the sheets coming from the paper path section 35. The sheets entering the paper path section 34 from the entry point 36 are starting their first pass along the print head or print assembly 31 in the loop.

The sheets coming from the paper path section 35 are starting their second pass along the print head or print assembly 31 in the loop. When a sheet has passed the print head or print assembly 31 for the second time in the second pass, the sheet is transported to the inlet 53 of the output section 5.

The input section 4 may comprise at least one input holder 44, 45, 46 for holding the image receiving material before transporting the sheets of image receiving material to the print engine and control section 3. Sheets of image receiving material are separated from the input holders 44, 45, 46 and guided from the input holders 44, 45, 46 by guiding means 42, 43, 47 to an outlet 36 for entrance in the print engine and control section 3. Each input holder 44, 45, 46 may be used for holding a different kind of image receiving material, i.e. sheets having different media properties. While 3 input holders are illustrated in FIG. 1, the number of input holders may include one, two, three or more input holders.

The local user interface 7 is suitable for displaying user interface windows for controlling the print job queue residing in the controller 37. In another embodiment a computer N1 in the network N has a user interface for displaying and controlling the print job queue of the printing system 1.

Figure 2:
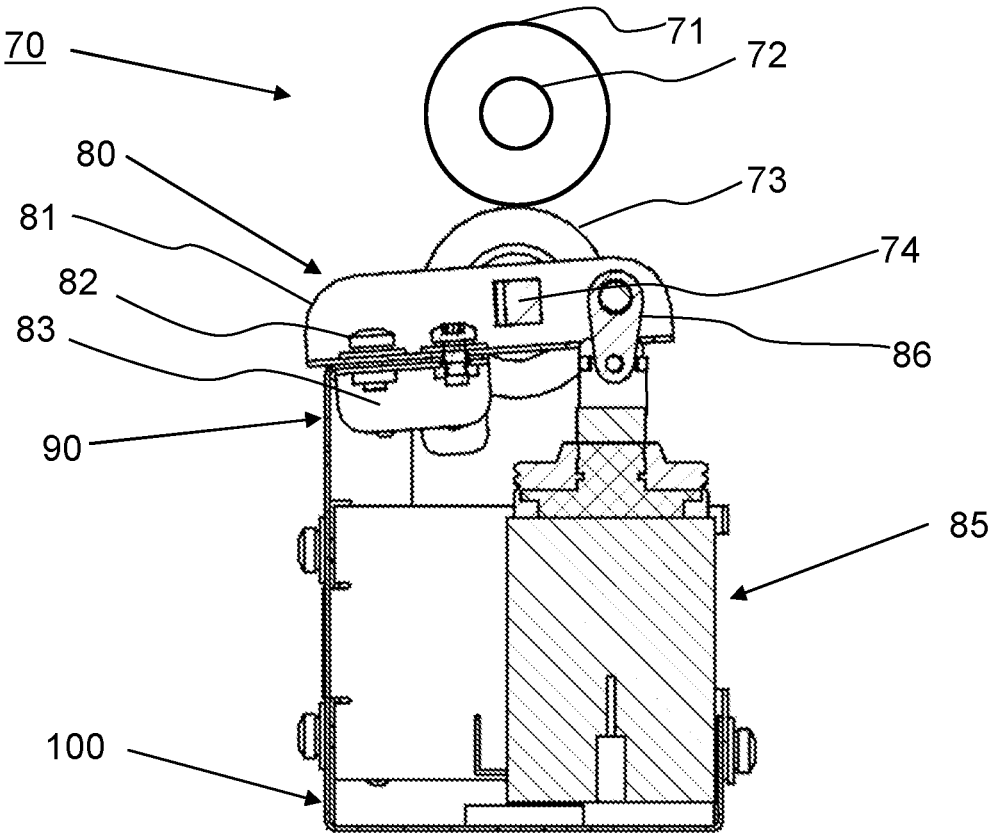
FIG. 2 is a cross-sectional side view of a transport device according to the present invention.

FIG. 2 shows a transport device 70 as may be applied along any of the transport path sections 32, 33, 34, 35 in FIG. 1. The transport device 70 in FIG. 2 is a so-called liftable transport pinch 70, which comprises two opposing rollers 71, 73 one of which may be driven by a drive or motor to transport the image receiving material further along the respective transport path section 32, 33, 34, 35. The transport device 70 comprises an actuator 85 for positioning the rollers 71, 73 between a first and a second position. In the first position the rollers 71, 73 are adjacent and/or in contact, such that the image receiving material passing between the rollers 71, 73 is in good contact with the driven roller 71, 73 for reliably transporting the image receiving member without or with little slippage. The first position is generally referred to as 'closed.' In the second position the rollers 71, 73 are relatively remote from one another, such that the image receiving member may pass through the rollers 71, 73 relatively unengaged or unaffected by the transport device 70 save for support from below. The second position is generally referred to as 'open', as the image receiving member may pass through the transport pinch 70 without being locally held or pinched by the rollers 71, 73. In FIG. 2, the rollers 71, 73 are in the first position. While in this example, roller 71 is provided with a drive (not shown) for rotating the roller 71 around its axis 72, such a drive may instead of or also be provided for the roller 73.

FIG. 2 shows the roller 73 being rotatable around axis 74, which axis 74 is mounted on the arm 80. The arm 80 comprises a first beam 81 with a U-shaped cross-section and a second beam 82 with a U-shaped cross-section, which are mounted onto one another by means of fasteners 83 in the form of screws 83. The U-shaped cross-sections of the beams 81, 83 ensure a relatively high rigidity of the arm 80 to avoid oscillations due to elastic deformation of the arm 80. The arm 80 is connected to the frame 100 via the elastic hinge element 90. The elastic hinge element 90 further defines the pivot axis (93 in FIGS. 3 and 4) around which the arm 80 may pivot when actuated by the actuator 85. The actuator 85 is illustrated as a solenoid 85, though other suitable actuators such as pneumatic or linear actuators may further be applied with the context of the present invention. The actuator 85 engages the arm 80 by means of the attachment element 86.

The attachment element 86 is connected to both the actuator 85 and the arm 80 to allow of sufficient freedom of movement for both the pivoting of the arm 80 and the motion of the actuator 85. The attachment element 86 may thereto be rotatably or deformably mounted with respect to the arm 80 and/or the remainder of the actuator 85.

The elastic hinge element 90 is formed of a bent plate 90, which is mounted to the frame 100. The elastic hinge element 90 provides a simple and cheap means for mounting the transport device 70 to a frame 100 of a printer. This reduces costs in terms of material and assembly time. The elastic hinge element 90 further defines the pivot axis of the arm 80. This is advantageous in terms of wear on the pivot axis as compared to e.g. an arm provided on a rod by means of a bearing that allows the arm to pivot around the rod. In a high production environment print speeds up to 300 or more sheets per minute may be reached, requiring the transport pinch 70 to operate at the same frequency. With a suitable selection of materials and dimensions a long lifetime of the elastic hinge element 90 can be reached. Further, the elastic hinge element 90 acts as a damper when it is deformed from its rest position, which prevents oscillations of the arm 90 after actuation. As in the indicated, the actuation may be relatively fast, such that when the arm 80 hits it stop element (not shown) with relatively high impact, this will cause the arm 80 to bounce back and forth. This oscillation is reduced or even eliminated, as the elastic hinge element 90 is capable of generating a relatively large elastic counter force to dampen such an oscillation. Additionally, the elastic hinge element 90's simple construction helps in reducing play in the transport device 70. In consequence, the operation is relatively energy efficient, as the elastic hinge element 90 contributes to reducing hysteresis, specifically spring hysteresis. The rest position (corresponding to the undeformed state) of the hinge element 90 may be suitably selected to lie in between the first and second position or at one of those positions, dependent on the requirements of the transport device 70.

Figure 3:
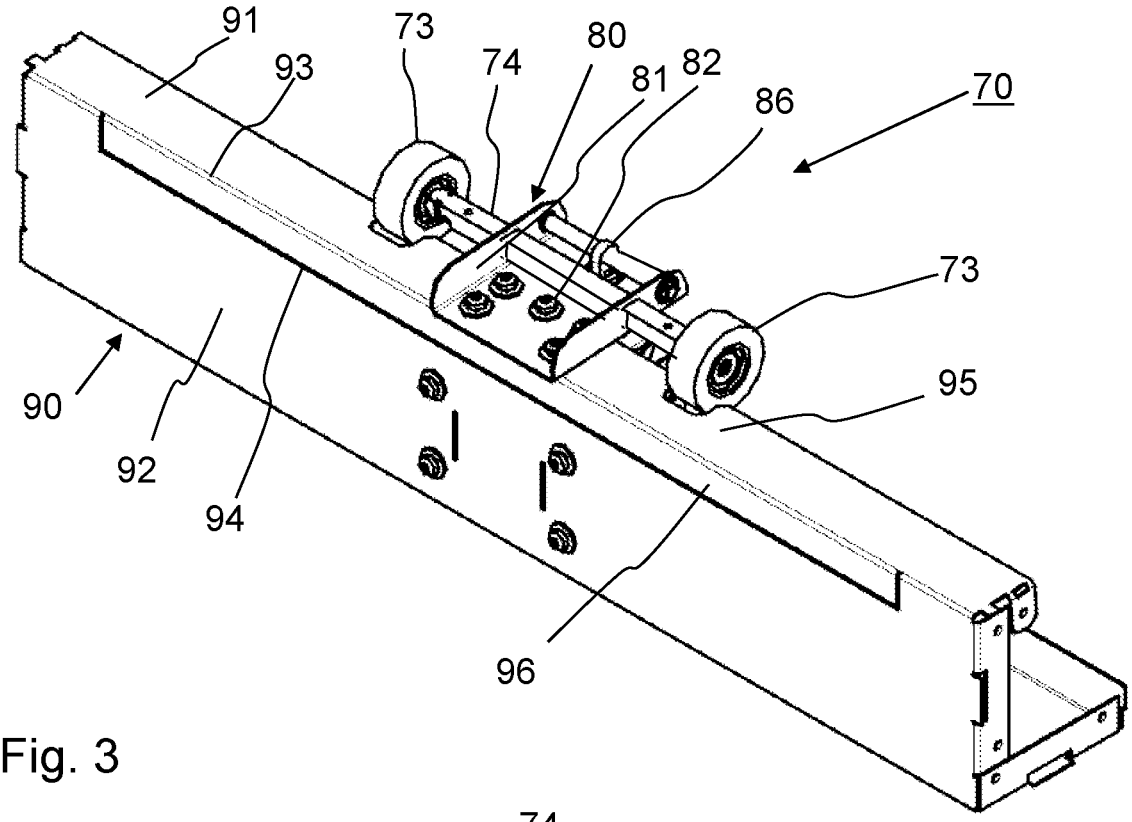
FIG. 3 is a rear perspective view of the transport device in FIG. 2.
Figure 4:
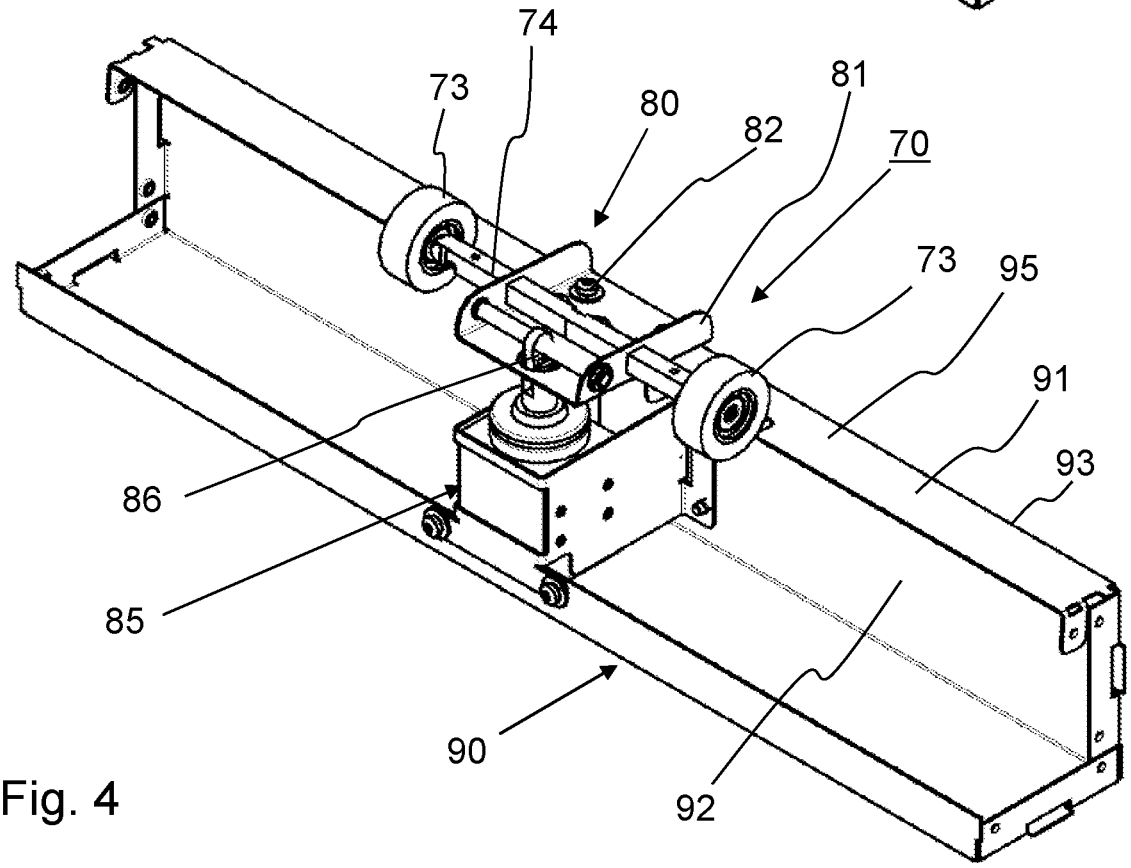
FIG. 4 is a front perspective view of the transport device in FIGS. 2 and 3.

FIGS. 3 and 4 illustrate the elastic hinge element 90 in a perspective view. The elastic hinge element 90 is formed of a folded metal plate. Other suitable elastic materials other than metal may be applied, such as plastics or composite materials. The plate 92 of the hinge element 90 is folded around the fold line 93. The hinge element 90 has a first plate portion 95 on a first side of the fold line 93 on which first plate portion 95 the arm 80 is mounted. A second plate portion 96 extends on an opposite side of the fold line 93. The hinge element 90 is connected to the frame 100, such that one of the first of the second plate portions 95, 96 is moveable around the fold line 93 with respect to the frame 100. In FIG. 3, the second plate portion 96 is formed by a channel 94, which extends between two different points along the fold line 94. The channel 94 is a cut-out or elongated through-hole that allows the second plate portion 96 to move with respect to the remainder of the plate 92. The first plate portion 95 is secured to the frame 100 at its lateral ends. The first plate portion 95 does not substantially move, but deforms as the arm 80 is moved. The second plate portion 96 is substantially free to pivot or fold around the fold line 93. The channel 94 provides sufficient local deformability in the plate 92 to allow the arm 80 to move between its first and second position under the force of the actuator 85. It will be appreciated that the second plate portion 96 may also be omitted and an equally large opening may be provided in the plate 92 at the location of the second plate portion 96.

The plate 92 is mountable onto the frame 100 of the printer 1. In FIG. 4 mounting points for fasteners, specifically screws, are provided at the lateral sides of the plate 92. The connection to the frame 100 secures the plate 92 at two fixed points on opposite sides. The fixation prevents the plate 92 from translating or rotating, ensuring that movement of the arm 80 is achieved through deformation of the elastic hinge element 90 alone. In consequence, an elastic counter force or dampening force acts on the arm 80 when it moves from the first to the second position and/or vice versa. The elastic deformation of the hinge element 90 does not rely on any moveable parts requiring bearings and is thus very wear resistant. The arm 80 is substantially more rigid than the elastic hinge element 90, such that forces on the arm 80 entirely or for the large majority affect a deformation of the hinge element 90. Deforming the hinge element 90 results in an opposing force urging the hinge element 90 back to its rest position. The counter force prevents or reduces oscillations of the arm 80, which effectively reduces the time required for switching. This allows consecutive image receiving members to be positioned closer together, which in turn increases the total number of image receiving members which can be processed at a certain transport velocity.

The elastic hinge element 90 is comprised in the plate 92. The plate 92 extends laterally along the width of the respective transport path section, such that it can be easily mounted to the frame. By mounting the plate 92 to the frame 100, the external degrees of freedom of the plate 92 are fixed, such that moving the arm 80 results in an elastic deformation of the hinge element 90. The plate 92 further the pivot axis of the arm 80 by its fold line 93, while also providing a dampening force when the hinge element 90 is deformed. Thus, the support for the arm 80, its damper, and its pivoting means are integrally formed from the plate 92. It will be appreciated that the arm 80 may further be integrally formed with plate 92 by providing a suitable cut-out for the arm, and even for forming a U-shaped beam element by bending sections of the plate.

Figure 5:
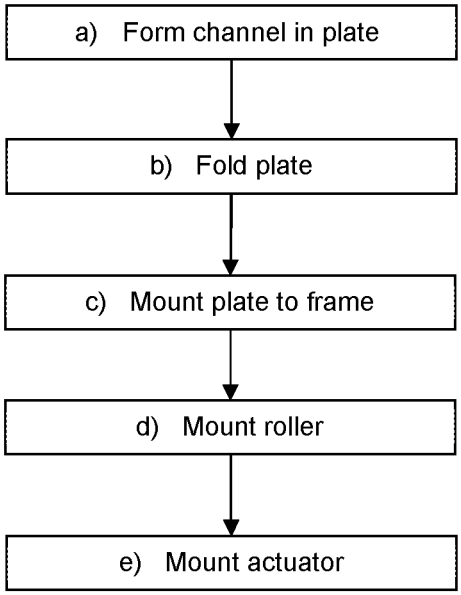
FIG. 5 is a block diagram illustrating the steps of a method for forming the transport device in FIGS. 2 to 4.

FIG. 5 schematically illustrates the steps for forming the transport device 70. The elastic hinge element 90 is formed by the optional step a, in which the channel 94 is formed in the plate 92. The plate 92 is further folded along its fold line 93 to form the elastic hinge element 90. The angle wherein the plate 92 is folded is at angle greater than 45°, preferably a substantially right angle. The plate 92 is then secured to the frame 100, such that it as a whole is unable to translate or rotate. The roller 73 and the actuator 85 may be connected to the hinge element 90, for example via the arm 80. A drive roller 71 may further be provided opposite the roller 73.

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A transport device for a sheet printer comprising:
at least one roller mounted on an arm; and
an actuator connected to a frame for moving the roller between a first and second position,
wherein the arm is mounted onto the frame by means of an elastic hinge element,
wherein the hinge element is formed of a folded plate, and
wherein the hinge element is defined by a channel in the plate.

2. The transport device according to claim 1, wherein the elastic hinge element defines a pivot axis for the arm, the arm being pivotable around the pivot axis upon actuation by the actuator.

3. The transport device according to claim 1, wherein the elastic hinge element comprises a leaf spring.

4. The transport device according to claim 3, wherein the leaf spring is configured as a damper to reduce oscillation of the arm after actuating the arm between the first and second position.

5. The transport device according to claim 3, wherein the leaf spring is a folded leaf spring.

6. The transport device according to claim 5, wherein leaf spring is folded at angle of at least 45°.

7. The transport device according to claim 5, wherein the leaf spring is folded at a substantially right angle.

8. The transport device according to claim 1, wherein the channel extends between two points adjacent a fold line around which the plate is folded.

9. The transport device according to claim 1, wherein the arm is rigid.

10. The transport device according to claim 9, wherein the arm comprises at least one beam element with a U-shaped cross-section.

11. The transport device according to claim 1, wherein the first and/or second position is defined by a stop element for limiting the movement of the arm, and wherein the elastic hinge element dampens oscillations of the arm after the stop element has been contacted.

12. The transport device according to claim 1, wherein a further roller is positioned opposite the roller, such that in the first position the rollers are adjacent and/or in contact with one another and in the second position the rollers are spaced apart from one another.

13. A sheet printer comprising:
a print head or print assembly configured to fix marking material to an image receiving material; and
the transport device according to claim 1 configured to move the image receiving material.

14. A method for forming the transport device for a sheet printer, comprising the steps of:
mounting at least one roller on an arm;
connecting an actuator to a frame for moving the roller between a first and second position;
mounting the arm to the frame with an elastic hinge element forming the elastic hinge element by folding a plate;
connecting the at least one roller and the actuator to the elastic hinge element; and
forming a channel in the plate.

15. The method according to claim 14, further comprising the step of folding the plate over a fold line, wherein the channel and the fold line together fully surround a portion of the plate.

16. The method according to claim 15, wherein the channel and the fold line define an opening in the plate.

17. The method according to claim 16, wherein a portion of the plate is moveably provided in the opening.

* * * * *